US005908087A

United States Patent [19]

Johansson

[11] Patent Number: 5,908,087

[45] Date of Patent: Jun. 1, 1999

[54] TANDEM DRIVING DEVICE OF A STAIR LIFT

[76] Inventor: Bengt Johansson, Pl 215, Kyrkesund, S-440 60 Skarhamn, Sweden

[21] Appl. No.: 08/737,007

[22] PCT Filed: May 1, 1995

[86] PCT No.: PCT/SE95/00480

§ 371 Date: Oct. 31, 1996

§ 102(e) Date: Oct. 31, 1996

[87] PCT Pub. No.: WO95/29867

PCT Pub. Date: Nov. 9, 1995

[30] Foreign Application Priority Data

May 1, 1994 [SE] Sweden ..... 9401486

[51] Int. Cl.[6] ..... B66B 9/08

[52] U.S. Cl. ..... 187/201

[58] Field of Search ..... 187/201, 200, 187/245, 240

[56] References Cited

FOREIGN PATENT DOCUMENTS

| | | | |
|---|---|---|---|
| 560433 A1 | 9/1993 | European Pat. Off. | 187/201 |
| 403061278 | 3/1991 | Japan | 187/201 |
| 405116868 | 5/1993 | Japan | 187/201 |

*Primary Examiner*—Kenneth Noland
*Attorney, Agent, or Firm*—Young & Thompson

[57] ABSTRACT

A tandem driving device (1) of a stair lift to bring the stair lift (10, 11) along a guiding system (2, 3), consists of an upper calibrated guiding rail (2) and a lower guiding rail (3), enabling the stair lift to pass sharp corners during inclination of the lift. Two driving roller units (M1, M2) with on pair of rollers (4, 6; 5, 7) in each, are interconnected by a broken hinge (8*a*, 8*b*), the longitudinal axis of which intersects the longitudinal axis of the guiding system. The contacting surfaces of at least the driving roller (rollers) (4; 5) engage the upper rail (2) and have a friction-increasing resilient layer. The rollers are biased toward the upper guiding rail (2) by a spring.

4 Claims, 4 Drawing Sheets

TANDEM DRIVING DEVICE OF A STAIR LIFT

The present invention relates to a tandem driving device of a stair lift to bring the stair lift along a guiding system.

BACKGROUND OF THE INVENTION

There are many advantages both individually and to the society if disabled people can keep on living in a well known environment at home. Aid to move between different floors can be one condition for disabled people to keep on living and act in a wellknown environment. Hereby the possibilities to obtain a high quality in life is increased. This can be explained by the fact that the daily ususal routines once being automated in the brain can continue to work without too conscious efforts far up in the old age as long as the brains of the old people doesn't are exposed during a short period of time to too many new impressions (to a great pressure of information). This can happen when moving from the old housing to a home for the aged. Thus, the older people will then often be quite dependent upon external help. Neurophysiologically this can be explained by the fact that behaviour patterns in the brain being used to, which can work excellent in the old environment at home, does not often manage to adopt to new environments with many new impressions. There is a risk that the behaviour patterns collaps.

PRIOR ART

To-day there is an established technique for wall mounted conveying systems for stair lifts. Preferably the stair lifts shall be able to pass over horisontal passages along the extension of stairs which is inclining, and through sharp curves. For this reason the most usual stair lifts have been made positively guided, and maybe driven along both upper and lower rails, normally included in the guiding system. Heretofore an exact parallellity must exist beween these two rails, one monunted above the other at the wall along the stairs. Often this kind of guiding system involves a close measuring of the stairs itself in a coordinate system, and later to have a specific guiding system specially manufactured at the factory and mounted onto the wall at the stairs with an absolute precision. This procedure is circumstantial and often involves several visits from mechanics and needs later adjusting to have the stair lift arrangement to function as expected. One example of such a stair lift is shown in WO 92/14673.

EP-A- 0143737 disclose a stair lift having two rails at different levels and where a guiding of the stair lift along both these rails require an excakt adaption and installation of all the components forming part of the system.

DE-A-3 934 431 disclose a stair lift using just one supporting or guiding rail. A handle or a seat is movably arranged along the rail. At this device the problem with parallellity and positive drive of the lift between two guiding rails has been excluded. It is true that the device shown in this dockument is exemplary simple, but when carrying a sitting person along stairs this person will probably experience the trip as hazardous and instable. The center of gravity of the load and lifting device must always be directely under the suspension point.

THE OBJECTS OF THE INVENTION

The main object of the present invention is to obtain a technique with a great degree of safety to comfortably run a stair lift along a conveying system fitted onto a wall and which also can be arranged in curves at the same time as the stair itself is very steep. The technique includes both a method to run the stair lift and a driving device for the stair lift only engaging a single guiding system passing between different floors in a building.

Another object of the invention is to obtain av driving device for a stair lift with double driving motor devices to maintain the action also when one driving motor device is out of order.

Yet another object of the invention is to obtain a technique not requiring expensive and complicated messurment, special manufacturing and a later mounting of a guiding system, but instead use bent and calibrated pipe components being easily connected and mounted in place with special pressing tools without to great requirements onto insertion and exact adjustments of mainly upper and lower rails.

THE INVENTION

By positively control the platform of the stair lift to a horisontal position independetly of changing in inclinement of the guiding system along the stairs, the person carrying stair lift will be able to move smoothely and comfortably. Preferably the single guiding system comprises first upper rails onto which the driving device of the stair lift is run, and a second, lower supporting component, which in one embodiment of the invention can be arranged in direct connection to the upper rail and may be formed of a protruding flange portion integral with a pipe profile, towards which e.g. a rotably mounted roller runs onto the stair lift. By the positiv control of the stair lift an inclination caused by mass forces and by the rolling/dragging contact towards a lower support of the stair lift will be prohibited.

Level indicators may be arranged along the guiding system to make a lowering of the speed of the platform, when arriving curves, or in changes of the inclination possible. This is done to avoid unpleasently experienced acceleration and redardation forces.

By using a calibrated rail in the guiding system with a cross section as circular as possible and rollers in the driving device of the stair lift with corresponding part circular profiled surfaces engaging the rail a line contact between the rollers and the rail is estalished. An elastic layer at the engageing surfaces of the rollers and/or at the surface of the rail creates a greater engaging surface between rollers and rail. Furthermore the rollers are resiliently biased towards the rail. Under no circumstances the rollers can be brought so far from each other that there is a risk for the driving device of the stair lift to become loosened from or be out of contact with the rail.

By using two units of roller means in the driving device of the stair lift with two opposed rollers in each, wherein at least one of the units has one drivning roller and a reaction roller, which units are connected by a hinge, the two rollers will by its line engagement with the rail, be mutually and positively guided onto this rail. Preferably the stair lift is carried by the forward roller unit onto a tap and is in alignment with a rotation axis of the upper roller in the forward roller unit—as seen when the stair lift is moving upwards.

The hinge connecting the two roller units is broken at passing the centre of the rail and is asymmetrically extending from one body portion external of the rail. By arranging the hinge pivotable in just one direction the stability will increase when passing straight portions of the guiding system. This is important when a not loaded lift, i.e. when the pressure between rollers and the rail is at a minimum. This transferring of a not loaded stair lift will often happen as several persons are using the one and same lift and a call for the lift by e.g. IR-transmitter may be done if the lift is not at the same floor as the person wanting to use it. This means that the lift device will be transferred without any load between the floors.

By having two driving means, one at each roller unit with one driving motor at each driving each driving roller, it is possible to ensure the action of the lift also if one driving device will fail. It is important that users of a stair lift of this kind are ensured that they don't risk to be sitting at the middle of the stairs without any possibility to move up or down. When there is an interruption in electricity supply it is possible to move down by a manual manipulation of the lift and/or by having a battery powered driving device, which means that the electricity supply to the shifting motor is ensured.

The driving means of the stair lift is also equipped with a seperate falling latch, i.e. a device being released when the downward speed of the lift has exceeded a predetermined acceptable value. The falling latch will mechanically grip around the upper rail and will stop the lift in about 5 cm after exceeding said allowed speed. At steep portions of the guiding system the falling latch can be arranged to be activated and stop the lift in a distance of 2–3 cm.

EMBODIMENTS

The invention will now be described by way of example with reference to the accompanying drawings in which.

Figure 5:
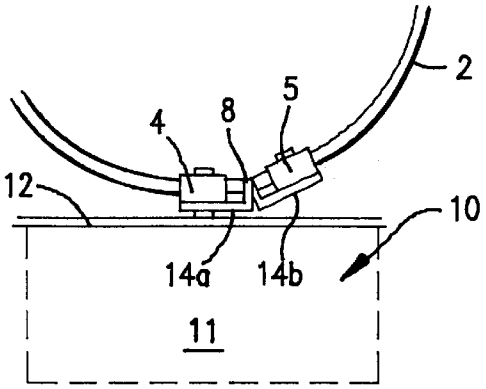
Figure 4:
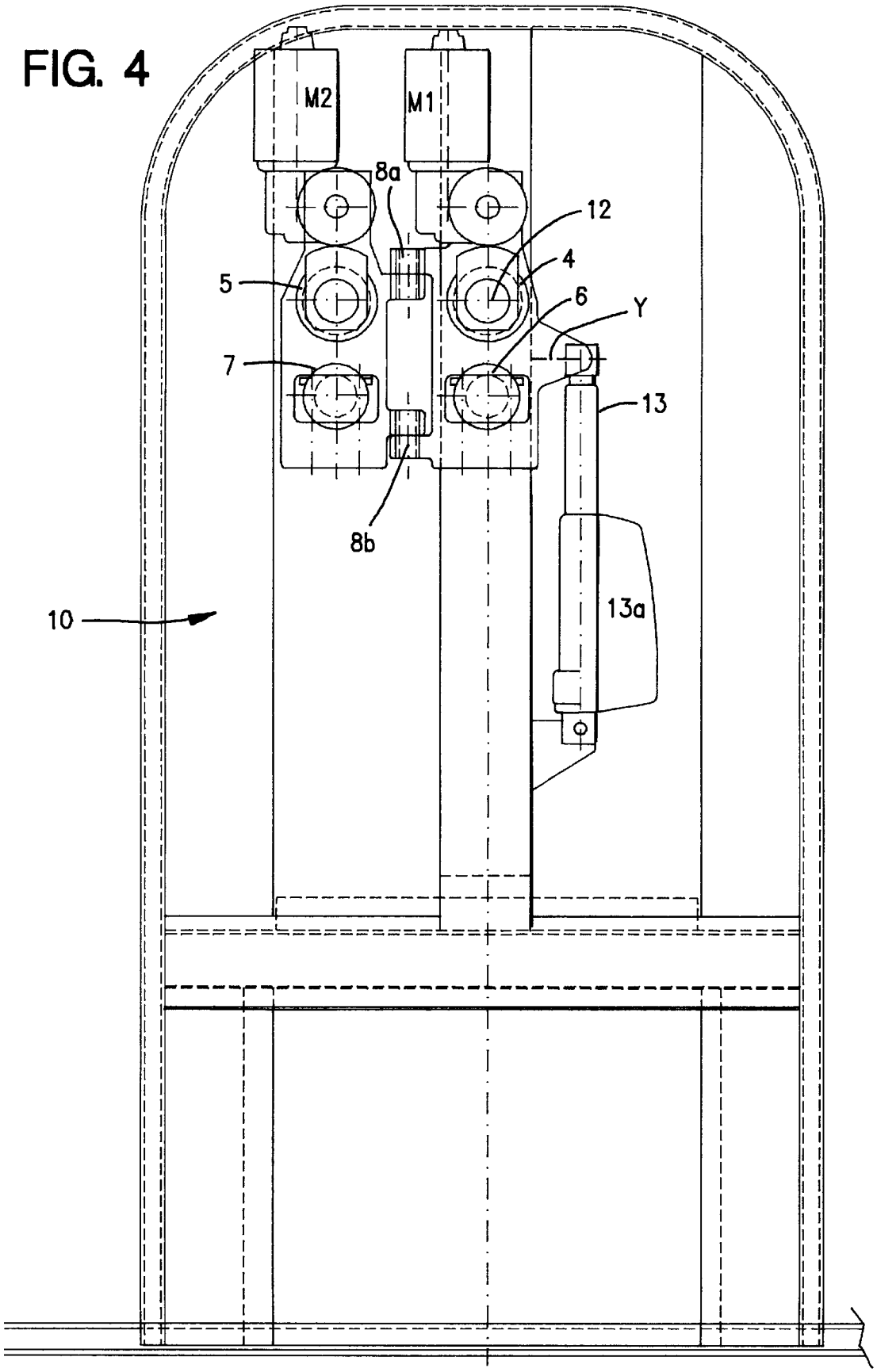

FIG. 4 shows the back portion of the stair lift with a pivotally connected tandem driving device and the connection of a mechanical shifting device between the tamdem driving device and the stair lift; and wherein FIG. 5 shows a diagrammatic view from above of the tandem driving device and the stair lift running onto an essentially horisontally curve portion at an upper rail forming part of the guiding system, and where the driving devices are excluded for clarity.

Figure 1:
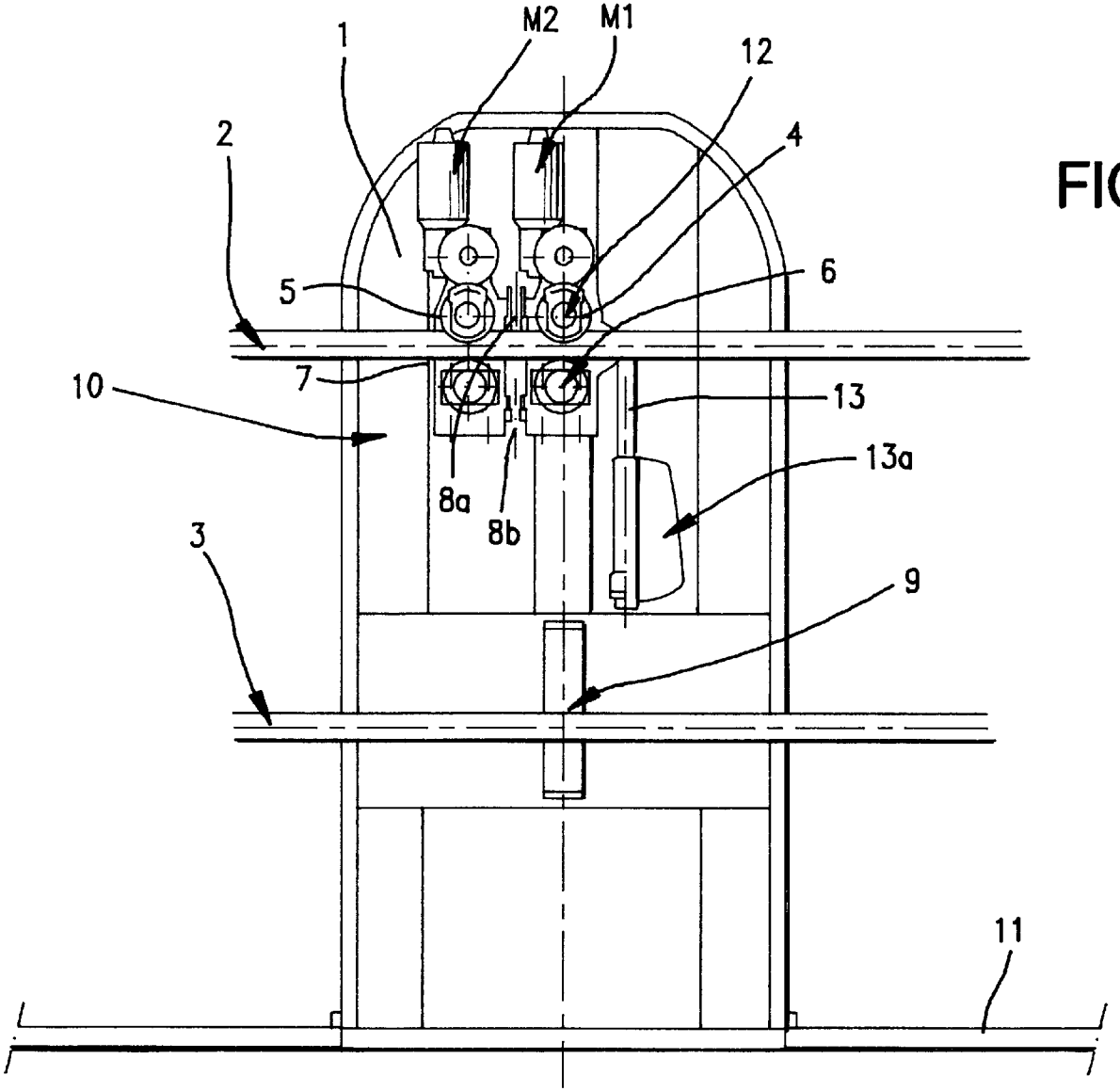
FIG. 1 is a diagrammatic part of a stair lift according to the present invention from the inside, i.e. seen from e.g. the wall of stairs, at a horisontal portion of the guiding system comprising lower and upper rails and with a horistontally set platform, e.g. for a wheel chair.

FIG. 1 shows a diagrammatic side view from behind of a stair lift with a driving device 1 of the stair lift in the shape of at tandem drive device to bring a stair lift along a guiding system consisting of two rails 2 and 3. The tandem drive device has two motor driven roller units M1 and M2 with two driving rollers 4, 5 and two opposite reactive rollers 6, 7 in each unit. Preferably the transmissions between the motors and the driving rollers are by gears. The units M1 and M2 are connected by a "broken" hinge 8*a*, 8*b*, the longitudinal axis of which intersects the centre of the longitudinal axis of the guiding system.

The driving rollers 4, 5 are engaging around the upper rail 2 and one or several vertical roller means 9 at the stair lift bear on a lower pipe or supporting rail 3. The stair lift has a back 10 which carries a platform 11 at its lower portion. The stair lift 10, 11 is connected by a pivot 12 to the tandem driving device M1, M2 with drive and reactive rollers 5,7; 4,6, respectively. A mechanical shifting means 13 with a shifting motor 13*a* will turn the platform around the pivot 12 so that the platform always will be in a horisontal position. Thus a turning between the stair lift 10, 11 and the tandem drive units M1 and M2 will occure.—Se also FIGS. 2 and 4.—It is important that the two dirivning wheels 4, 5 and reactive wheels 6,7 at the tandem driving device M1,M2 will run at a smooth and even surface at the upper rail 2 to eliminate uncomfortably experienced shocks and vibrations. This decreases the risk of suddenly decreased contact surfaces between the drivning rollers/reactive rollers and the rails, and also the risk of slipping.

The two drivning units M1, M2 of the tandem driving device are interconnected by a "broken" hinge 8*a*, 8*b*. This arrangement enables for the stair lift to pass sharp corners during simultane inclinements i both the horisontal and the vertical planes. The leading driving unit M1 will always strive to be in a vertical plane as it is positively attached to the back of the platform, and the other driving unit M2 is inclined as much as nescessary when entering and passing curves at the guiding system. This happens with a nescessary pressure from the driving rollers and the reactive rollers.

Figure 2:
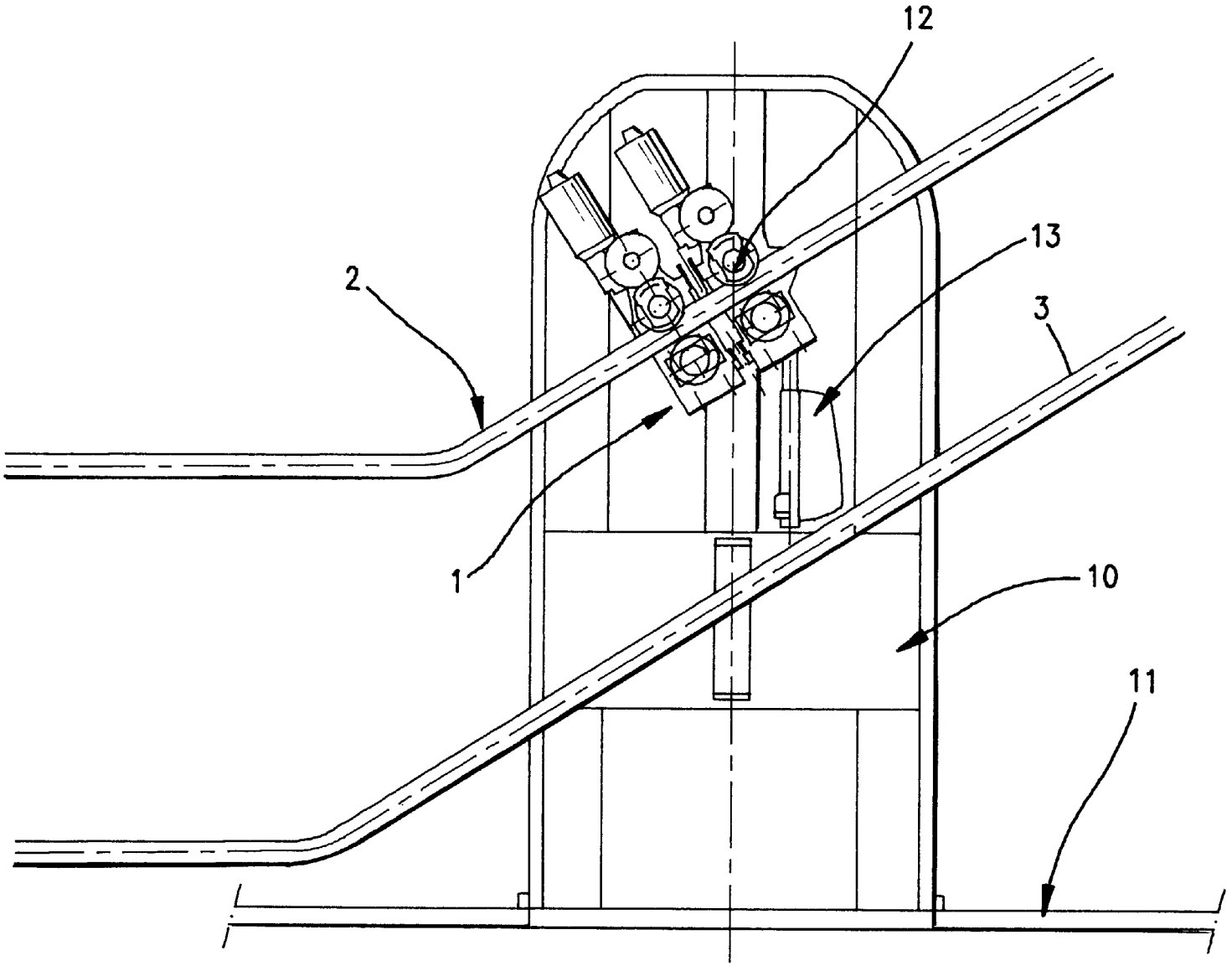
FIG. 2 is a side view as in FIG. 1 but with the stair lift in an inclining part of the guiding system and with the platform still kept in a horisontal position.

In FIG. 2 a side view according to FIG. 1 is shown but with the stair lift at an inclining portion of the guiding system 2, 3 and with the stair lift 10, 11 in a set horisontal position during action from the shifting means 13 thus expanding and increasing the distance beween the pivotal attachment of the shifting means at the driving device 1 and the stair lift 10, 11, i.e. the shifting means will perform a horisontal positive adjustment of the stair lift. The output to the shifting means 13 for shifting is obtained from angular sensors (angular transmitters—not show) which may act according to the inertia principle. They shall be arranged at the stair lift. One alternative embodiment can have gyro means with a housing, wherein a pendulum will deviate when the stair lift is shifting from its horisontal position. The pendulum can be connected to transmitter means which can be semi protected (inducativ or capacitive transmitters). Such transmitters are known and there are no difficulties for a man skilled in the art to chose and arrange one transmitters for this application.

Figure 3:
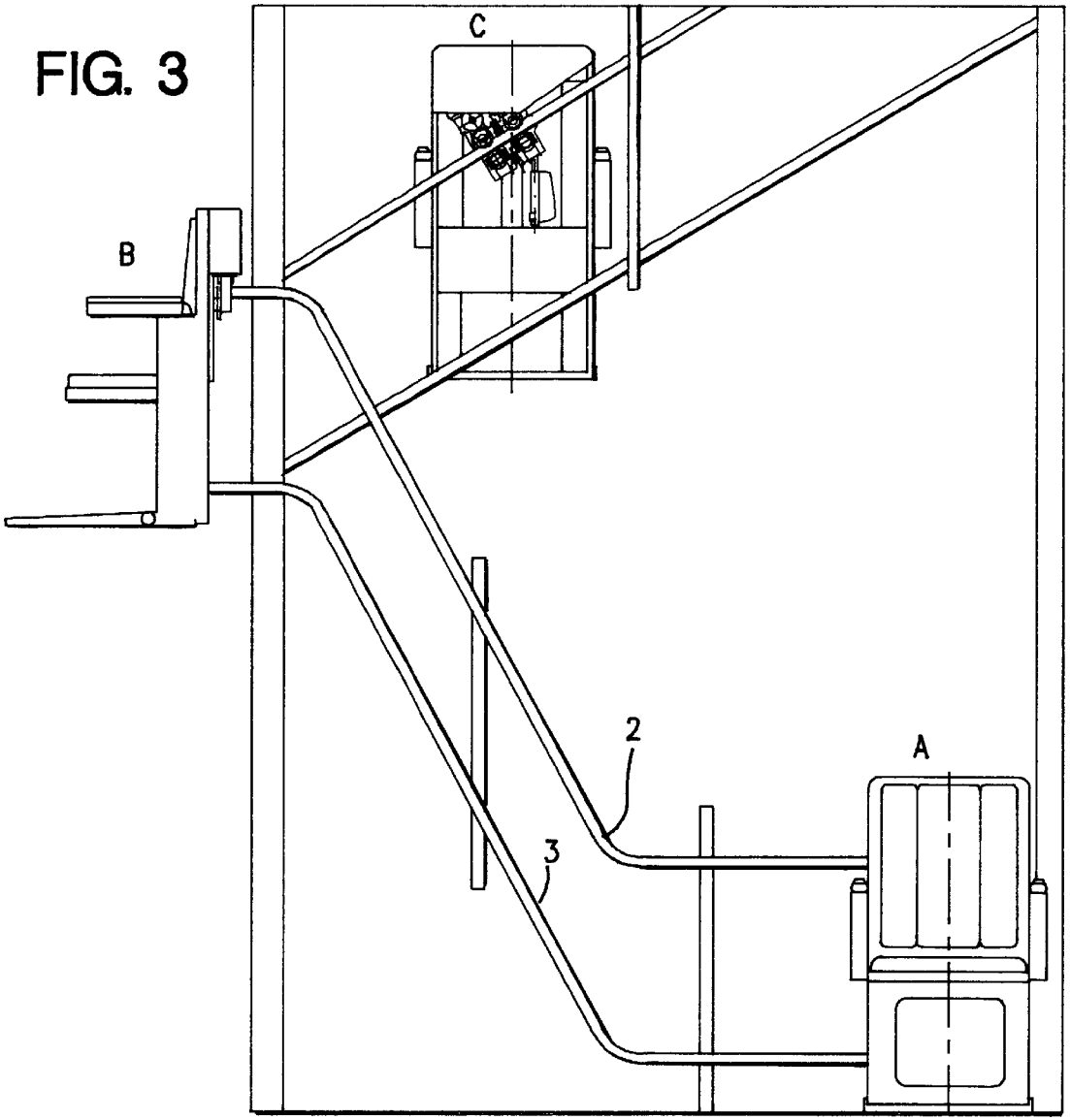
FIG. 3 is a diagrammatic side view of a stair lift with a seat device for transport of a sitting person not using a weel chair, wherein three different positions of the stair lift are shown along the guiding system.

FIG. 3 is a diagrammatic side view of a stair lift, here equipped with a seat instead of a platform carrying a wheel chair, i.e. for transport of a sitting person not using a wheel chair. The three positions A, B, C for the stair lift device is shown along the guiding system 2, 3. This stair lift distinguishes from the One shown in FIGS. 1, 2 by having a seat instead of a platform. Here a sliding surface of a material with a low frictional coefficient, e.g. a plastic material such as TEFLON can be used. This sliding surface can be combined with roller means. This means that the stair lift will bear on the lower rail 3 forming part of the guiding system and slide against this rail during its displacement up and down stairs.

In FIG. 4 the back portion of the stair lift is shown pivotally connected—by the pivot 12—to the tandem driving device M1,M2 and the attachement of the mechanical shifting means 13 between the tandem driving device and the stair lift 10, 11. Thus, with the variable lever Y existing by influence of the force N from the shifting device, said force will give rise to the shifting torque (P×Y) Nm.

FIG. 5 shows a diagrammatic view from above of the drivning rollers 4, 5 resp. of the tandem drivning device M1,M2 running onto an almost horisontal curve portion at the upper rail 2 forming part of the guiding system. The drivning motors are not shown to make the view clear. The stair lift 10, 11 is suspended in the tandem driving device by a pivot 12. Preferably this pivot is aligned with the rotation axis of the leading and upper driving roller 4. Here is also shown how the broken hinge 8 is asymmetrically arranged and passes through the centre of the rail. Hinge parts 14*a* and 14*b* with apertures are asymmetrically arranged and extend both above and below the rail 2.

The invention is not restricted to the shown and described embodiments, but modifications can be done within the scoope of the following claims.

I claim:

1. A tandem driving device (1) of a stair lift to bring the stair lift (10,11) along a guiding system (2, 3), consisting of a upper calibrated guiding rail (2) and a lower guiding rail (3), enabeling the stair lift to pass sharp corners during a simultane inclinement of the lift, characterized in two driving roller units (M1, M2) with one pair of rollers (4, 6; 5, 7) in each, said units being interconnected by a broken hinge (8*a*, 8*b*), the longitudinal axis of which intersects the longitudinal axis of the guiding system, the contacting surfaces of at least the driving roller (rollers) (4; 5) engaging the upper rail (2) have a friction increasing resilient layer and that said pair of rollers are biased towards said upper guiding rail (2) by a spring force.

2. Device according to claim 1, characterized in that the stair lift is pivotatbly connected to one of the roller units (M1,M2) engaging the upper rail (2).

3. Device according to claim 2, characterized in that the hinge (8) is broken in such a way that it is divided into two parts (8*a*, 8*b*), one part (8*a*) above and another part (8*b*) below the guiding system (2), and is pivotable in just one direction.

4. A tandem driving device (1) according to claim 1, characterized in that the stair lift (10,11) has level sensor means connected to a mechanical shifting device (13).

* * * * *